United States Patent [19]

Kowalski, deceased et al.

[11] 3,945,056

[45] Mar. 23, 1976

[54] DUAL FLUSH TOILETS

[76] Inventors: Frank Kowalski, deceased, late of Alexandria, Val, by Helene Bober Kowalski, executrix, 7204 Regent Drive, Alexandria, Va. 22307

[22] Filed: Mar. 21, 1974

[21] Appl. No.: 453,362

[52] U.S. Cl. ..... 4/67 A; 4/37

[51] Int. Cl.[2] ..... E03D 1/30

[58] Field of Search..... 4/67 R, 67 A, 37, 34, 57 R, 4/57 P

[56] References Cited

UNITED STATES PATENTS

| | | | |
|---|---|---|---|
| 3,047,882 | 8/1962 | Goodwin | 4/67 A |
| 3,067,432 | 12/1962 | New | 4/67 A |
| 3,108,286 | 10/1963 | Moore | 4/67 A |
| 3,199,118 | 8/1965 | Moschetta et al. | 4/67 A |

*Primary Examiner*—Robert I. Smith

[57] ABSTRACT

This invention provides a modification kit by means of which a conventional toilet of the flush tank type may be converted into a dual flush system. The mechanism is mounted and secured inside a flush tank on the front wall of the tank and is operationally connected to the flushing lever and the water outlet valve. The invention incorporates a float which may be selectively controlled by the flushing handle on the outside of the tank to permit a vertical float type outlet valve or a flapper type outlet valve to close at a reduced or full flush of the toilet at the discretion of the user. In part this disclosure is an improvement on a previous invention described in full in my patent application Ser. No. 261,303 (Series of 1970).

4 Claims, 10 Drawing Figures

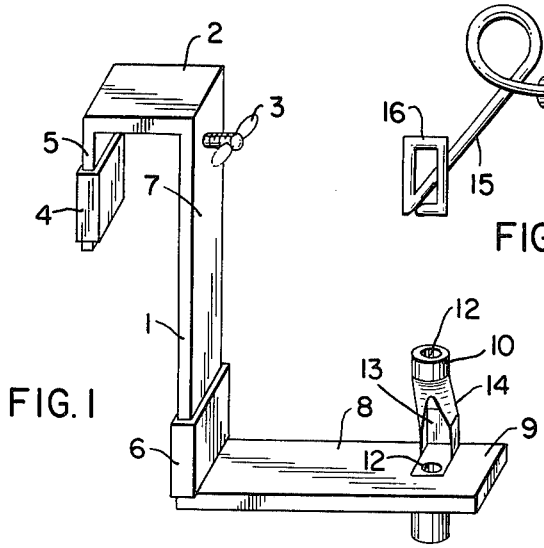
FIG. 1
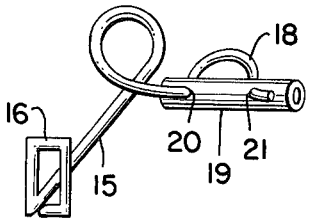
FIG. 2
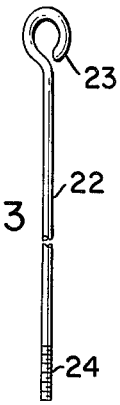
FIG. 3
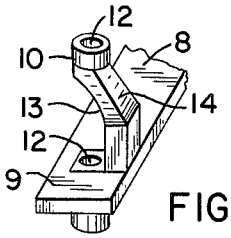
FIG. 5
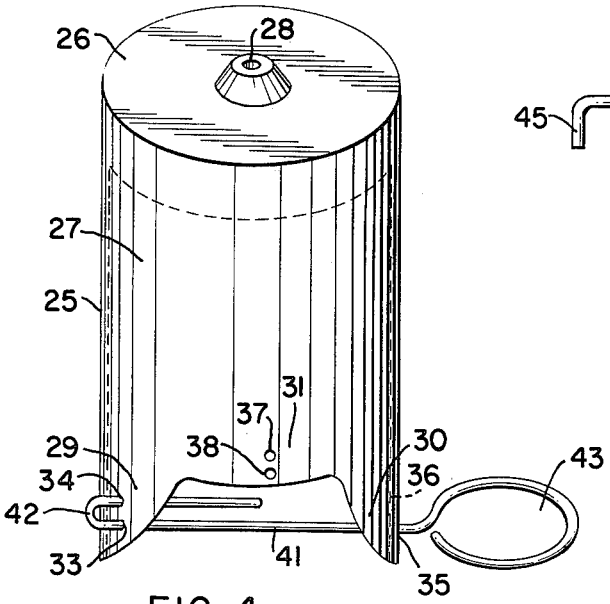
FIG. 4
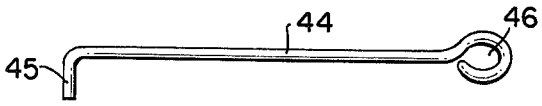
FIG. 6
FIG. 7
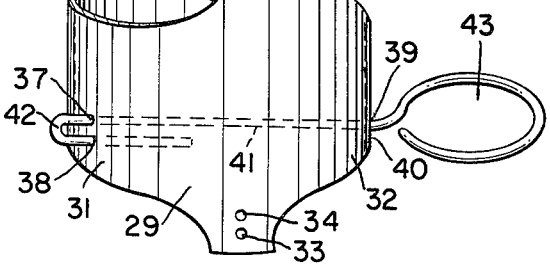

DUAL FLUSH TOILETS

RELATED INVENTIONS

U.S. Pat. Nos. 2,106,906; 2,351,672; 2,526,294; 2,532,977; 3,538,519.

My previous Patent application Ser. No. 261,303 (series of 1970).

BACKGROUND OF THE INVENTION

1. Field of the Invention

Often in conventional flush tank toilets less than a full tank of water will satisfactorily flush the toilet. Accordingly, one way to conserve water, which is so wastefully flushed through toilets, is to provide a selective flushing system which utilizes a full flush cycle for solids and partial flush for liquids.

2. Description of Prior Art

Dual flush systems to achieve the above purpose follow four basic designs:

a. They utilize multiple outlet ports, set at two or more elevations in the tank. These ports can be selectively opened for the desired flush.

b. The large float which controls the water inlet valve, is utilized to close the outlet valve selectively.

c. The buoyancy of a hollow outlet valve is selectively controlled.

d. An independent float is selectively controlled so as to close the outlet valve at a desired elevation of the water in the tank.

Most of these mechanisms in the prior art have proved unreliable in daily operations or very costly to install.

SUMMARY OF THE INVENTION

The main purpose of this invention is to conserve water that is flushed through toilets. This objective is achieved through an improved modification kit which when installed in a flush tank toilet converts the toilet to a dual flush system, permitting selectively a full tank flush for maximum requirements or a reduced flush for lesser conditions. The modification kit described below can be utilized in toilets having the conventional vertical type outlet float valve or the more recent flapper type outlet valve.

An important objective of the invention is to provide a design which will take advantage of the conditioned behavior of the toilet user. In this connection, for a long time now, users have become accustomed to push down on the flushing handle located on the outside of conventional tanks. My invention deliberately utilizes this conditioned movement of the user to conserve water, for when the user pushes down and then releases the flushing handle, he automatically initiates a reduced flush. For a full flush, the user must push down on the flushing handle and then he must pull it up.

Another important objective of this invention is to provide a conversion kit which can be mounted on the inside of the tank on the front wall eliminating any requirement to replace any of the conventional elements in the toilet. A separate compact mechanism, this invention is designed so that it can be easily incorporated to operate with the various parts in conventional toilets.

Still another important objective of the invention is to provide a conversion kit which may be installed with little effort and without the use of any tools.

BRIEF DESCRIPTION OF THE DRAWINGS

These and other objectives will become apparent with reference to the following drawings and descriptions herein.

FIGS. 1, 2, 3 and 4, show in perspective the four major elements of the invention in an exploded vertical relationship. FIG. 1 shows a bracket, 1, made of flat metal suitably bent or molded so that at the top, 2, it has two right angled bends, forming an inverted U type clamp which may be fitted on top of the front wall of the flush tank. The bracket, 1, has a winged set screw, 3, with which the U–clamp is secured to the front wall of the tank. An elastic rubber-type sleeve, 4, is mounted on the short leg, 5, and a similar elastic rubber-type sleeve, 6, is mounted on the long leg, 7, near its bottom. At this point, a third right angled bend in bracket, 1, forms a platform, 8, which near its end, 9, has a vertical mount, 10, of which an additional view is shown in Fig. 5. Mount, 10 projects below platform, 8, forming a vertical extension, 11. A hole, 12, runs vertically through mount, 10, platform, 8, and extension, II. Mount, 10, further has a notch, 13, exposing vertical hole 12, as shown in Figs. 1 and 5. On the opposite side from notch, 13, mount, 10, has a shoulder, 14, whose surface, beginning at the top of mount, 10, slopes obliquely away from the vertical hole, 12, and then continues vertically down to the top of platform, 8.

FIG. 2 shows control link, 15, which is a wire suitably bent to form a vertical rectangular loop, 16, at one end. The wire continues horizontally from the bottom of loop, 16, to a suitable point where a vertical circular loop, 17, is formed. The plane formed by the wire of vertical rectangular loop, 16, is parallel to the plane formed by the wire of vertical circular loop, 17. From the bottom of loop, 17, the wire continues horizontally and is bent to form a horseshoe type of horizontal half-loop, 18. The plane of circular loop, 17, extends through the center of Half-loop, 18 and is perpendicular to the plane of half-loop, 18. A short elastic tube, 19, having holes, 20 and 21, near its ends (perpendicular to the long axis of elastic tube, 19) is mounted on control link, 16, so that the wire forming the half-loop, 18, fits through holes, 20 and 21, permitting tube, 19 to close the open side of half-loop, 18.

FIG. 3 shows a guide rod, 22, which at its top is bent to form a vertical circular loop, 23. At its bottom end, 24, guide rod, 22, is threaded.

FIG. 4 shows a cylindrical elastic rubber-type float, 25, closed at the top, 26, with a hollow interior, 27. In its top, 26, float, 25, has a small hole 28, which connects to a suitable nut inside top, 26. When the modification kit is assembled, as shown in FIGS. 8 and 10, guide rod, 22, fits vertically through half-loop, 18, of control link, 15, and then slides through vertical hole, 12, in mount, 10 and is screwed through hole, 28, in top, 26, of float, 25, securing guide rod, 22, to float, 25. The bottom cylindrical surface of float, 25, is cut out on opposite sides of the cylinder, so that surfaces, 29 and 30, shown also in FIG. 7, on opposite sides of the cylinder project below surfaces, 31 and 32. Suitable horizontal holes in pairs, one above the other are provided in each of these surfaces, i.e. holes, 33 and 34, are located in projecting surface, 29, as shown in FIGS. 4 and 7, holes, 35 and 36, in surface, 30, holes 37 and 38, in surface, 31, and holes, 39 and 40, in surface, 32. The surfaces and holes are so located at the bottom of float, 25, that a rod inserted through holes, 33 and 35, as shown in FIG. 4, would be set at right angles to a rod inserted through holes, 37 and 39, as shown in FIG. 7. Connector, 41, is made of wire suitably bent so that one end of the wire is formed into a tight U, 42, and at the other end is bent to form a horizontal circular loop, 43. The plane formed by U, 42, is perpendicular to the plane of circular loop, 43. Connector, 41, as shown in FIG. 4, may be mounted in float, 25, by inserting the wire through hole, 35 then through holes, 33 and 34, or as shown in FIG. 7, through hole, 39, then through holes, 37 and 38. The holes located at right angles to each other are set at two different elevations in float, 25, to accommodate two different-sized tanks found in common usage today — one tank designed to hold water in the tank at a level of 10 inches above the bottom and another size which holds the water level at 9 inches above the bottom of the tank. The two locations of connector, 41, shown in FIGS., 4 and 7, permit the use of float, 25, with either sized tank. Connector, 41, with its wide horizontal circular loop, 43, is designed for use in toilets with a flapper type out valve (FIG. 8). Connector, 44, shown in FIG. 6, is designed for use in toilets equipped with vertical type outlet float valves (FIG. 10). Connector, 44, like connector, 41, is a wire suitably bent so that at one end it has a right angled projection, 45, and at the other end has a horizontal circular loop, 46. The plane formed by the main strand of connector, 44, and projection, 45, is perpendicular to the plane of circular loop, 46. Connector, 44, may be fitted in holes, 33 and 35, as shown in FIG. 10, or inserted in holes, 37 and 39 in float, 25, for use in the two different sized flush tanks.

FIG. 8 shows the modification kit detailed in FIGS. 1, 2, 3 and 4, mounted inside a flush tank equipped with a flapper type outlet valve. For mounting the kit in the tank, chain, 47, is unhooked from flushing lever, 48. The modification kit is placed inside the tank with float, 25, down. Flushing lever, 48 (which is operationally connected in a conventional flush tank to a flushing handle located on the outside of the tank, not shown) is inserted into the vertical circular loop, 17, of control link, 15, and then slid through vertical rectangular loop 16, as shown in FIG. 8, and bracket, 1, is clamped over the top of front wall, 49, of the flushing tank. Bracket, 1, is suitably adjusted on wall, 49, so that platform, 8, projects from wall, 49, towards overflow tube, 50. Chain, 47, which is connected to flapper valve, 51, is then brough up through horizontal circular loop, 43, of connector, 41 and then hook, 52, of chain, 47, is hooked through a suitable hole in the flat end of flushing lever 48. Winged set screw, 3, is tightened, securing bracket, 1, and the modification kit to the front wall, 49, of the flush tank.

Figure 8:
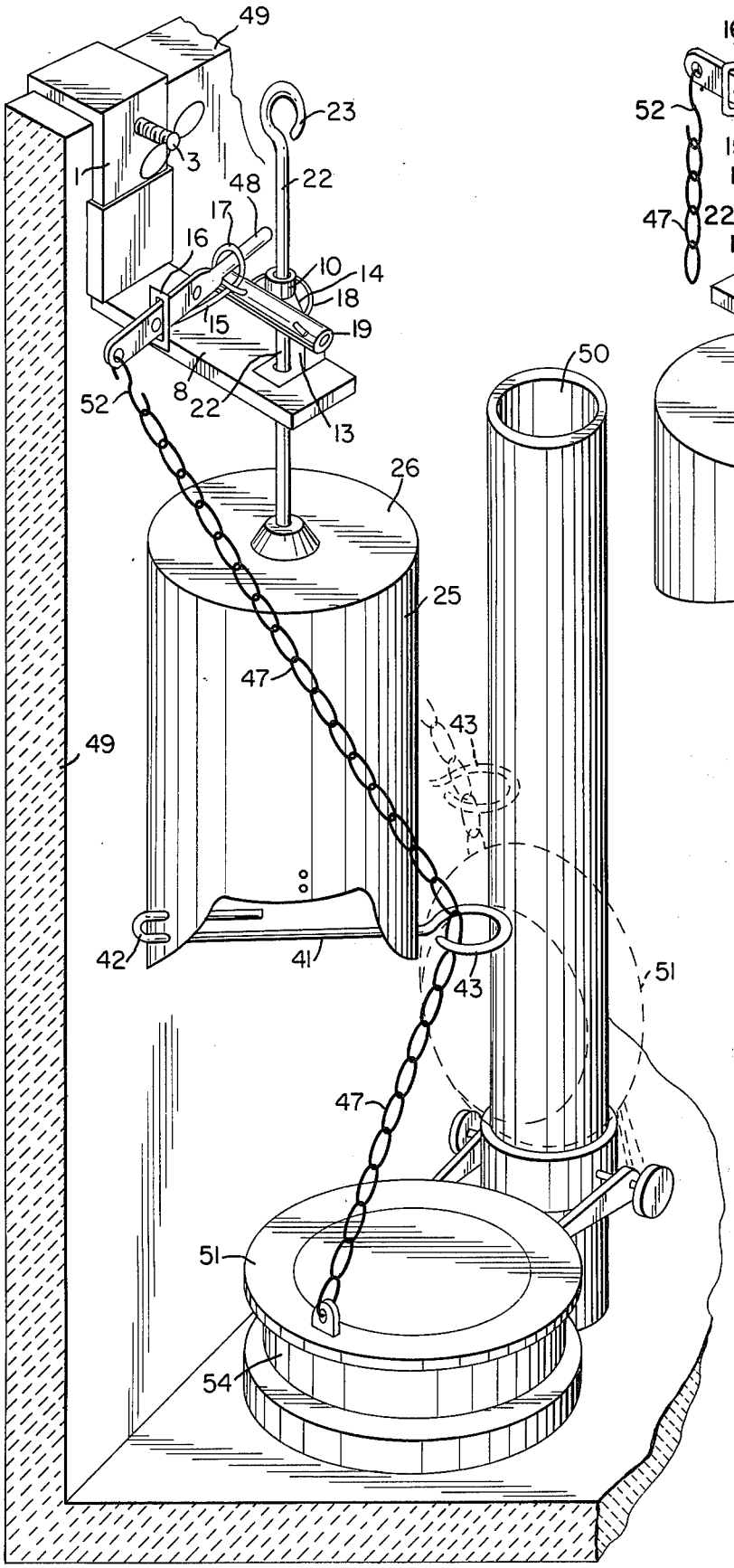
FIG. 8 shows the modification kit mounted on the inside of a flush tank secured to the front wall of the tank and incorporated operationally with a flapper type outlet valve.

In operation, for a reduced flush, the flushing handle on the outside of the tank (not shown) is depressed and then released as in a conventional flush. When the flushing handle is depressed, the flushing lever, 48, operationally connected to the flushing handle, rises, causing chain, 47, which is connected to flushing lever, 48, to pull flapper valve, 51, up from its seat in outlet 54, until flapper valve, 51, floats in the water above outlet, 54, as shown by broken lines in FIG. 8. In this position of flapper valve, 51, chain, 47, has been pulled up through horizontal circular loop, 43, of connector, 41, and loop, 43, rests on top of flapper valve, 51. At the same time that chain, 47, raises flapper valve, 51, flushing lever, 48, lifts control link, 15, with half-loop, 18, and elastic tube, 19, engaged and guided upward on guide rod, 22. Water in the meantime flushes through outlet, 54, from the tank into the toilet bowl. When the flushing handle outside the tank is released, flushing lever, 48, inside the tank falls by gravity, causing control link, 15 to slide downward engaged on guide rod, 22, until wire half-loop, 18, comes to rest on the upper part of shoulder, 14, of mount, 10, on bracket, 1. With control link, 15, in the position shown in FIG. 8, as the water level in the tank falls, float, 25, falls with the level of water, causing circular loop, 43, of connector, 41, to exert a downward force on the top surface of flapper vslve, 51. At a predetermined level of water in the tank, float, 25, drops sufficiently to cause loop, 43, to force flapper valve, 51 down to a position above outlet, 54, where the water, flushing out of the tank, sucks flapper valve, down onto its seat in outlet, 54, closing outlet, 54, shutting off the flow of water into the toilet bowl. The predetermined water level mentioned above is selected to provide a satisfactory partial flush. With outlet, 54, closed, the water inlet mechanism (not shown) fills the tank with water as in a conventional flushing cycle.

Figure 9:
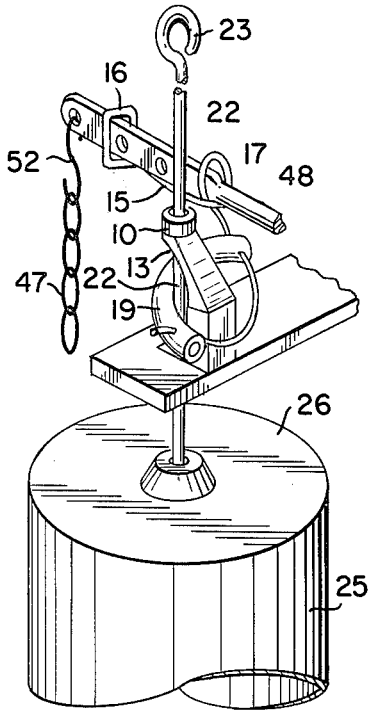

For a full flush, the flushing handle outside the tank (not shown) is depressed and then pulled up. When the flushing handle is depressed, flushing lever, 48, inside the tank, is lifted, causing flapper valve, 51, to uncover outlet, 54, permitting water to flush from the tank into the toilet bowl and at the same time raising flapper valve, 51, to the position shown by broken lines in FIG. 8. When the flushing handle outside the tank is pulled up, flushing lever, 48, inside the tank, is forced downward, causing control link, 15, and its half-loop, 18, to slide vertically down engaged on guide rod, 22, forcing elastic tube, 19, and half-loop, 18, down over mount, 10, of bracket, 1, until the bottom surfaces of half-loop, 18, come to rest on platform, 8, as shown in FIG. 9. In this position of control link, 15, elastic tube, 19, is forced into notch, 13, engaging and holding the vertical segment of guide rod, 22, which is exposed in notch, 13. Guide rod, 22, and with it float, 25, are secured firmly in bracket, 1, restraining float, 25, to fall with the water level in the tank. Under these circumstances, flapper valve, 51, is unaffected by float, 25, and accordingly functions as in a conventional toilet, closing outlet, 54, when a full tank of water has been flushed. With the outlet, 54, closed, the water inlet mechanism (not shown) fills the tank with water in the conventional manner, and the toilet is ready for subsequent operations.

Figure 10:
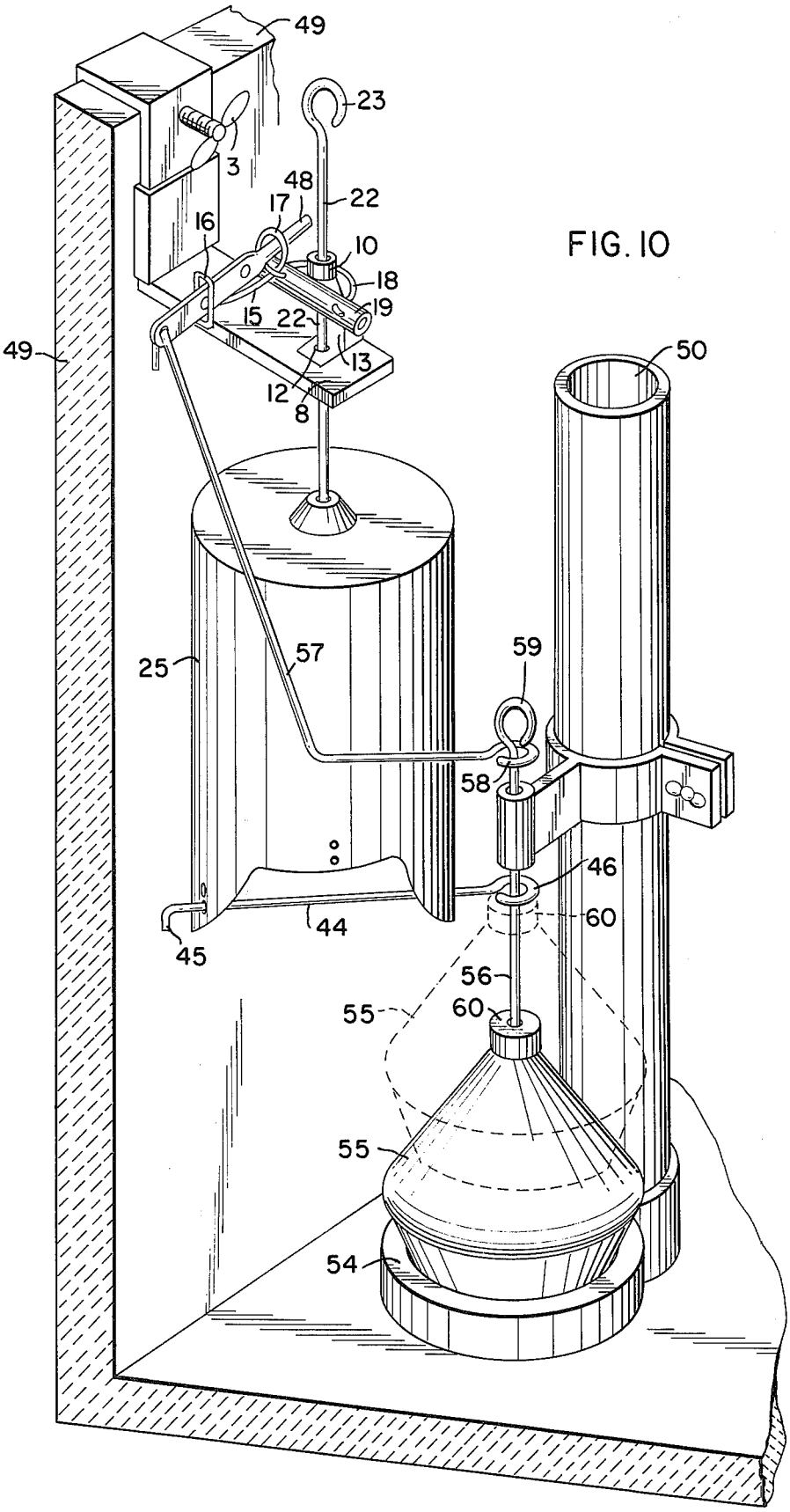
FIG. 10 shows the kit incorporated operationally in a toilet having a conventional vertical type outlet float valve.

FIG. 10 shows the modification kit, described in detail in FIGS. 1, 2, 3 and 4 with connector, 44, instead of connector, 41, engaged in float, 25. The kit is mounted and secured to front wall, 49, of a flush tank equipped with a vertically operated outlet float valve, 56. After the kit is mounted in the tank, as described for a toilet equipped with a flapper type outlet valve, lifter rod, 56, is screwed out of float valve, 55, lifted vertically, and then engaged in connector, 44, through circular loop, 46, and screwed again into float valve, 55.

In operation, for a reduced flush, the flushing handle outside the tank (not shown) is depressed and released as in a conventional flush. When the flushing handle is depressed, flushing lever, 48, inside the tank, rises lifting control link, 15, as described in FIG. 8. At the same time link, 57, which is hooked by its upper end through a suitable hole in the flat portion of flushing lever, 48, is pulled upward. The upper surfaces of circular loop, 58, located at the lower end of link, 57 exert an upward force on the lower surfaces of circular loop, 59, located at the top of lifter rod, 56, pulling lifter rod, 56, and float valve, 55, upward until the top, 60, of float valve, 55, comes to rest against the bottom surfaces of circular loop, 46, of connector, 44. With float valve, 55, floating in the water above outlet, 54, in the position shown by broken lines in FIG. 10, the water flushes out of the tank through outlet, 54, into the toilet bowl. When the flushing handle outside the tank is released, the flushing lever, 48, inside the tank falls by gravity, causing the control link, 15, to assume the position shown in FIG. 10. With this position of the control link, 16, as the water level in the tank falls, float, 25, is free to drop with the level of water in the tank causing the bottom surfaces of circular loop, 46, of connector, 44, to exert a downward force on top, 60, of float valve, 55. At a predetermined water level in the tank, float, 25, drops to a point, where the water flushing out of the tank through outlet, 54, sucks float valve, 55, down onto its seat in outlet, 54, shutting off the flow of water from the tank into the toilet bowl. The predetermined water level, mentioned above, is selected so that the float valve, 55, is forced down onto its seat in outlet, 54, by the action of float, 25, closing the outlet when a satisfactory partial flush has been achieved. With outlet, 54, closed, the water inlet mechanism (not shown) fills the tank with water as in a conventional flushing cycle.

For a full flush, the flushing handle outside the tank is depressed and then pulled up. When the flushing handle is depressed, the action initiates the opening of outlet, 54, flushing water from the tank into the toilet bowl. When the flushing handle outside the tank is pulled up, flushing lever, 48, inside the tank, is forced down, causing control link, 15, downward, as described above to a position on mount, 10 of bracket, 1, shown in FIG. 9. Guide rod, 22, is restrained from falling by elastic tube, 19, which has been forced by the downward movement of control link, 15, into notch, 13. In this position of control link 15, (FIG. 9), float 25, is restrained from falling with the water level in the tank, permitting lifter rod, 56, and float valve, 55, to function in the conventional manner, closing outlet, 54, when a full tank of water has been flushed. As described above, with outlet, 54 closed, the conventional water inlet mechanism (not shown) fills the tank with water and the toilet is ready for further operations.

I claim:

1. A conversion kit construction, for converting a flush tank toilet equipped with a flapper type outlet valve to a dual flush system, comprising, a bracket fashioned for mounting and securing said kit inside said tank on the front wall of said tank, said bracket having a horizontal platform on which there is a vertical mount, said mount being provided with a hole through the vertical axis thereof, a recess in a lower side portion of said mount exposing said hole in said side of said mount, the surface of said mount opposite to the side having the recess being sloped from the top obliquely away from said vertical hole and and then vertically downward to the top of said platform of the bracket, a control link, made of wire suitably bent, forming at one end a vertical rectangular loop with a second vertical circular loop, suitably spaced from the first and with the planes of said loops parallel, said control link extending from bottom of said circular loop to form a horizontal horseshoe half-loop, so that the plane of said half-loop is perpendicular to the plane of said circular loop, and a segment of elastic tubing having holes near its ends perpendicular to the long axis of said tubing, arranged so that, the wire of said half-loop is inserted in said holes, permitting said elastic tubing to close the open side of said half-loop. a cylindrical rubber-type float, having a hollow interior portion, with one end of said cylinder closed to form the top of said float and a hole in said top operationally connected to a suitable nut arrangement secured in said top, the bottom portion of the wall of said cylinder having suitable holes, a wire connector inserted into said suitable holes so that one end of said connector extends outside said cylinder wall where it forms a horizontal circular loop and the other end of said connector is bent back upon itself and is engaged in two holes, one above the other, in said cylinder wall, securing said connector in a position perpendicular to the long axis of said cylinder and holding said circular loop of the connector in a horizontal plane, a guide rod of suitable length which, at its top, has a vertical circular loop and at its bottom end, is threaded, so that for assembling said conversion kit, said threaded end of the guide rod is inserted through the space inclosed by said wire half-loop and said elastic tubing of the control link, with the said guide rod then slid through said vertical hole in the mount on the bracket and then said threaded end of the guide rod is screwed into the said top of the float, permitting said guide rod attached to said float to slide vertically in said hole of the mount on the bracket and further permitting said control link to slide vertically on the upper portion of said guide rod, so that said half-loop and said elastic tubing of the control link may come to rest on the top surfaces of said mount, or said control link may be forced downward, causing said half-loop and said elastic tubing to slide over said mount until the bottom surfaces of said half-loop come to rest on top of said platform of the bracket and said elastic tubing is forced into said recess in the mount on the bracket, holding the exposed portion of said guide rod against the inside of said vertical hole in the mount, restraining said float from falling.

2. The conversion kit of claim 1 in assembled combination with the conventional elements of a flush tank toilet having a flush tank, a flapper outlet valve, a flat ended flushing lever, a flushing handle connected to the lever, and a chain connecting the flushing valve to the lever, said combination being so constructed and arranged that said bracket of said conversion kit is secured inside said tank on the front wall of said tank, the flat end of the conventional flushing lever is engaged through said circular loop and said rectangular loop of the control link, and further engages the conventional chain which is connected to the top of said flapper outlet valve through said horizontal loop of the wire connector and then is attached to said chain thus operationally connecting said conversion kit between said flushing lever and said flapper outlet valve.

3. A conversion kit construction, for converting a flush tank toilet equipped with a conventional vertically operated outlet float valve, to a dual flush system, comprising, a bracket fashioned for mounting and securing said kit inside said tank on the front wall of said tank and having a horizontal platform on which there is a vertical mount, said mount being provided with a hole through the vertical axis thereof, a recess in a lower side portion of said mount exposing said hole in the side of said mount, the surface of said mount opposite to the side having the recess, being sloped from the top obliquely away from said vertical hole and then vertically downward to the top of said platform of the bracket, a control link made of wire suitably bent, forming at one end a vertical rectangular loop with a second vertical circular loop, suitably spaced from the first and with the planes of said loops parallel with said control link extending from bottom of said circular loop to form a horizontal horseshoe half-loop, so that the plane of said half-loop is perpendicular to the plane of said circular loop, and a segment of elastic tubing having holes near its ends perpendicular to the long axis of said tubing, arranged so that, the wire of said half-loop is inserted in said holes, permitting said elastic tubing to close the open side of said half-loop, a cylindrical rubber-type float, having a hollow interior portion, with one end of said cylinder closed to form the top of said float and a hole in said top operationally connected to a suitable nut arrangement secured in said top, with the bottom portion of the wall of said cylinder having suitable holes, a wire connector inserted into said suitable holes so that one end of said connector extends outside said cylinder wall where it forms a circular loop and the other end of said connector, after penetrating the opposite side of said cylinder wall is bent downward at right angles, positioning said connector perpendicular to the long axis of said cylinder, a guide rod of suitable length which, at its top, has a vertical circular loop and at its bottom end, is threaded, so that for assembling said conversion kit, said threaded end of the guide rod is inserted through the space inclosed by said wire half-loop and said elastic tubing of the control link, with said guide rod then slid through said vertical hole in the mount on the bracket and then said threaded end of the guide rod is screwed into the said top of the float, permitting said guide rod attached to said float to slide vertically in said hole of the mount on the bracket and further permitting said control link to slide vertically on the upper portion of said guide rod, so that said half-loop and said elastic tubing of the control link may come to rest on top surfaces of said mount, or said control link may be forced downward, causing said half-loop and said elastic tubing to slide over said mount until the bottom surfaces of said half-loop come to rest on top of said platform of the bracket and said elastic tubing is forced into said recess in the mount on the bracket, holding the exposed portion of said guide rod against the inside of said vertical hole in the mount, restaining said float from falling.

4. The conversion kit of claim 1 in assembled combination with conventional elements of a flush tank toilet having a flush tank, a vertically operating outlet float valve, a flat ended flushing lever, a flushing handle connected to the lever, and a lifter rod and connector link connecting the flush valve to the lever, said combination being so constructed and arranged that said bracket of said conversion kit is secured inside said tank on the front wall of said tank, the flat end of the conventional flushing lever is engaged through said circular loop and said rectangular loop of the control link, and further engaging the connector link which is connected to the lifter rod, the circular loop of the wire connector in the float of the conversion kit is connected to the lifter rod and the threaded end thereof is screwed back into the top of said conventional outlet float valve operationally connecting said convension kit between the said conventional flushing lever and said conventional outlet float valve.

* * * * *